US006504304B1

(12) United States Patent
Lee et al.

(10) Patent No.: US 6,504,304 B1
(45) Date of Patent: Jan. 7, 2003

(54) MAGNETRON

(75) Inventors: Yong Soo Lee, Kyungki-do (KR); Jong Soo Lee, Kyungki-do (KR)

(73) Assignee: LG Electronics Inc., Seoul (KR)

( * ) Notice: Subject to any disclaimer, the term of this patent is extended or adjusted under 35 U.S.C. 154(b) by 19 days.

(21) Appl. No.: 09/689,711

(22) Filed: Oct. 13, 2000

(30) Foreign Application Priority Data

Jan. 18, 2000 (KR) ..... 00-2218

(51) Int. Cl.[7] ..... H01J 25/587
(52) U.S. Cl. ..... 315/39.75; 315/39.51
(58) Field of Search ..... 315/39.75, 39.51

(56) References Cited

U.S. PATENT DOCUMENTS 4,074,169 A * 2/1978 Harada ..... 315/39.75
5,049,782 A * 9/1991 Aiga et al. ..... 315/39.75 X
5,635,797 A * 6/1997 Kitakaze et al. ..... 315/39.75 X
5,861,716 A * 1/1999 Ogura ..... 315/39.51

FOREIGN PATENT DOCUMENTS

JP 6139946 * 5/1994 ..... 315/39.75

* cited by examiner

*Primary Examiner*—Benny T. Lee
(74) *Attorney, Agent, or Firm*—Birch, Stewart, Kolasch & Birch, LLP

(57) ABSTRACT

A high power magnetron is disclosed. The magnetron includes an anode. The anode has a cylinder positioned around a cathode, a plurality of vanes radially fixed to an inner wall of the cylinder, and straps mounted through the vanes. The inside diameter of the cylinder is 40–43 mm and the thickness of the cylinder is 2.8 mm or less. The magnetron is capable of not only reducing the thickness of its cylinder but also improving the thermal performance of the cylinder, thereby improving thermal stability of the cylinder, lengthening the life span of the cylinder and reducing the fabrication costs of the cylinder.

2 Claims, 2 Drawing Sheets

MAGNETRON

BACKGROUND OF THE INVENTION

1. Field of the Invention

The present invention relates, in general, to high power magnetrons and, more particularly, to a magnetron that is capable of reducing its thermal stress by varying the inside diameter and thickness of the cylinder of its anode, thereby improving the thermal stability of the anode.

2. Description of the Prior Art

As well known to those skilled in the art, magnetrons are devices for transmitting to the outside microwaves that are generated when an anodal current is applied. The magnetrons may be classified into magnetrons for electronic ranges and high power magnetrons. The magnetrons for electronic ranges or ovens can be employed to generate microwaves of a high frequency in electronic ranges, while the high power magnetrons can be employed in industrial purposes. Since the magnetrons generate a considerable amount of heat, the magnetrons generally are provided with cooling mechanisms. The magnetrons for electronic ranges are chiefly provided with air-cooling type cooling mechanisms, while the high power magnetrons are provided with either air or liquid-cooling type cooling mechanisms. The air-cooling type cooling mechanisms are employed for high power magnetrons generating relatively lower power, while the liquid-cooling type cooling mechanisms are employed for high power magnetrons generating relatively higher power.

As depicted in FIG. 1, a conventional high power magnetron employing an air-cooling type cooling mechanism includes a cylinder 11 positioned at its center portion. A plurality of vanes 12 and straps 13 are positioned in the cylinder 11, and form a resonance circuit when an anodal current is applied. A cathode 14 is positioned between the vanes 12, and serves to radiate a large number of thermions and to generate microwaves in an operation space between the cathode 14 and the inner ends of the vanes 12. An antenna 15 is mounted to transmit microwaves generated in the operation space. A plurality of cooling fins 16 are arranged around the cylinder 11, and serve to dissipate heat into which the remaining energy, which is not converted into microwaves, is converted. A pair of yokes 17 and 18 are respectively positioned over and under the cylinder 11, and serves to protect and support the anode and cooling fins 16 and to guide external air to the cooling fins 16. A pair of permanent magnets 19 are respectively positioned on the inner surfaces of the yokes 17 and 18, a filter box 20 is positioned on the outer surface of the lower yoke 18, and the permanent magnets 19 and the filter box 20 constitute a closed magnetic circuit.

As shown in FIG. 2, the anode of the magnetron comprises the cylinder 11, a plurality of vanes 12 mounted in the cylinder 11 and straps 13 mounted through the vanes 12 and forming a resonance circuit together with the vanes 12.

The high power magnetron constructed as described above generates microwaves of a high frequency and transmits these to a system.

When a predetermined amount of anodal current is applied to the cylinder 11, a resonance circuit is formed by the vanes 12 and the straps 13 in the interior of the cylinder 11 sealed under vacuum. If the resonance circuit is formed, microwaves are generated in the operation space between the inner ends of vanes 12 and the cathode 14. The generated microwaves are transmitted to the system through the antenna 15.

In such a case, most of energy generated in the operation space is converted to microwaves, but some of the energy remains and is converted to heat. This converted heat is conducted to the vanes 12 through the operation space and is dissipated outside of the cylinder 11. The heat dissipated through the cylinder 11 is cooled by means of a plurality of cooling fins 16 because the cooling fins 16 are arranged around the cylinder 11.

Briefly, in the conventional high power magnetron, when the cathode 14 is heated, most of energy is converted into microwaves, and the remaining portion of the energy converted to microwaves is converted into heat and transmitted to the vanes 12.

At this time, the vanes 12 are thermally deformed and extended radially, and the straps 13 mounted through the vanes 12 receive heat and are extended radially. Since the straps 13 are partially welded to the vanes 12, thermal stress corresponding to the difference between the thermal coefficients of the vanes 13 and the straps 13 causes the straps 13 and the vanes 12 to be deformed.

The portions of the straps 13 that are not welded to the vanes 12 may be severely deformed owing to the fixing force created on the welded portion of the straps 13.

In addition, the deformation of the vanes 12 is affected by the deformation of the cylinder itself 11 owing to heat transfer to the cylinder 11. For example, when the amount of the deformation of each vane 12 exceeds the amount of the deformation of the cylinder 11, contracting force is radially exerted on the vanes 12. On the other hand, when the amount of the deformation of each vane 12 is less than the amount of the deformation of the cylinder 11, the vanes 12 are radially elongated toward the cylinder 11.

The parts of the anode are under severe thermal stress because deformation occurs owing to their complicated mechanical connection and force is generated to resist the deformation.

The thermal stress is concentrated on the straps 13, and the straps 13 easily reach fatigue fracture. The life span of the magnetron generally depends upon the life spans of the cathode 14 and the straps 13. Accordingly, with regard to a magnetron, the sizes of its parts should be designed to be appropriate from a thermal point of view in connection with the power of the magnetron.

In a conventional high power magnetron of 1.7 KW, since its heat loss is great, the thickness of the cylinder of its anode is designed to be about 3.5–4.0 mm, on an average, 3.8 mm.

However, in such a case, since the deformation of the vanes 12 and the straps 13 and the deformation of the cylinder 11 are connected in a manner that is complicated, the thermal stability of the magnetron is deteriorated and the fabrication costs of the magnetron are increased owing to the excessive thickness of the cylinder 11.

SUMMARY OF THE INVENTION

Accordingly, the present invention has been made keeping in mind the above problems occurring in the prior art, and an object of the present invention is to provide a magnetron that is capable of not only reducing the thickness of its cylinder but also improving the thermal performance of the cylinder, thereby improving thermal stability of the cylinder, lengthening the life span of the cylinder and reducing the fabrication costs of the cylinder.

In order to accomplish the above object, the present invention provides a magnetron including an anode, the anode having a cylinder positioned around a cathode, a plurality of vanes radially fixed to the inner wall of the cylinder, and straps mounted through the vanes, wherein the inside diameter of the cylinder is 40–43 mm and the thickness of the cylinder is 2.8 mm or less.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
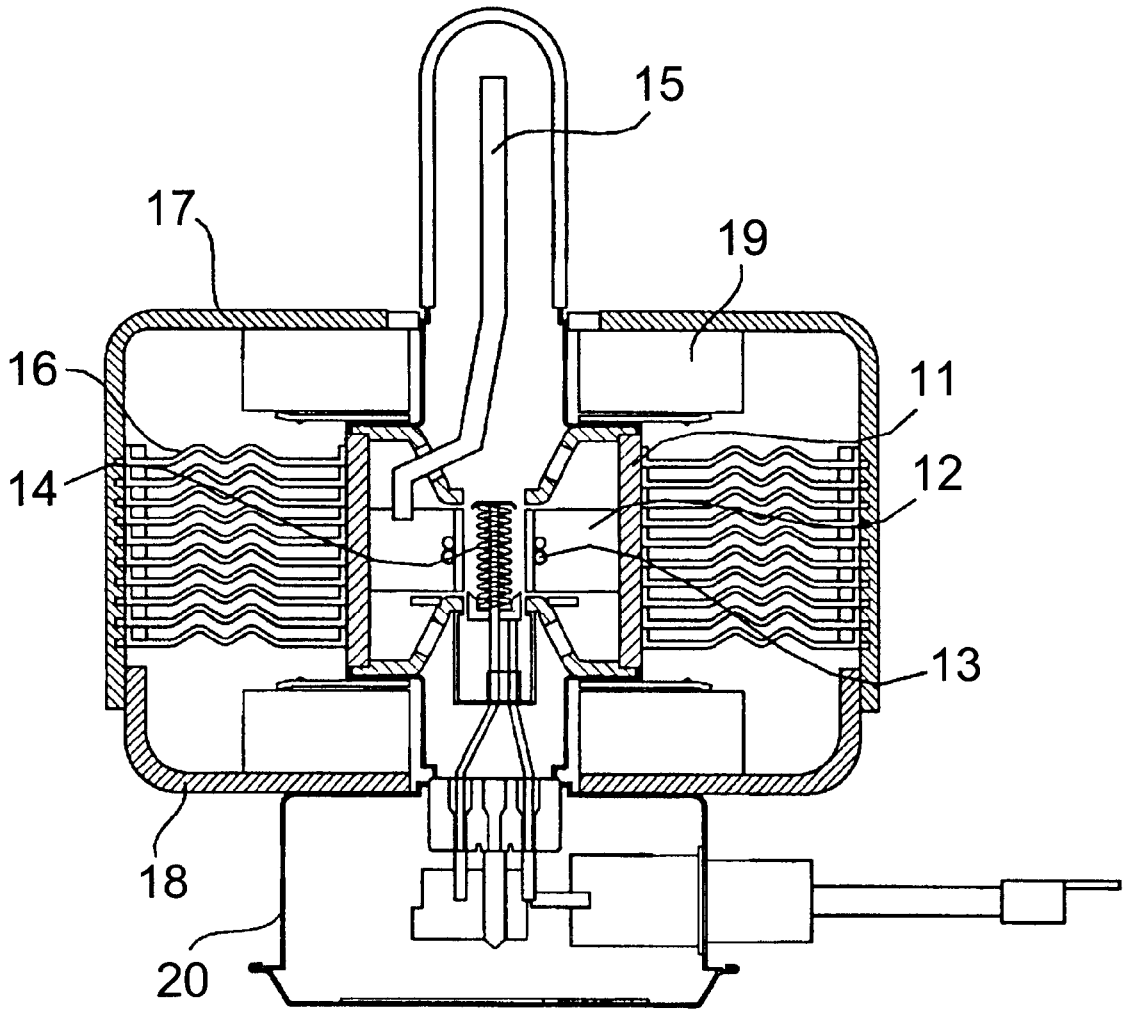
FIG.1 (Prior Art)
FIG. 1 is a partially sectional view showing a conventional high power magnetron.

Reference now should be made to the drawings, in which the same reference numerals are used throughout the different drawings to designate the same or similar components.

Figure 2:
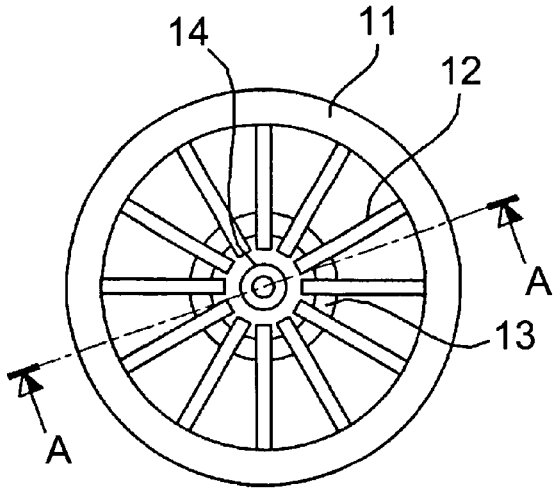
FIG.2 (Prior Art)
FIG. 2 is a plan view showing a conventional anode of a magnetron.

An anode of a magnetron according to the present invention comprises a cylinder 11 positioned around a cathode, a plurality of vanes 12 radially fixed to the inner wall of the cylinder 11 and straps 13 mounted through the vanes 12 and forming a resonance circuit together with the vanes 12 like the conventional anode of the magnetron shown in FIG. 2.

The high power magnetron having such an anode generates microwaves of a high frequency and transmits these to a system.

Figure 3:
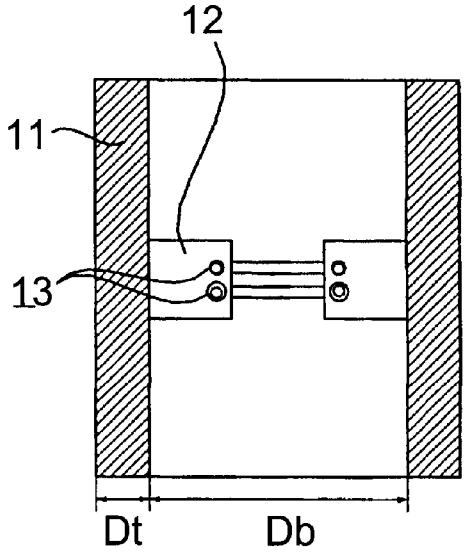
FIG. 3 is a cross section taken along line A—A of FIG. 2.

As shown in FIG. 3, the anode of the cylinder 11 of the present invention is 40–43 mm in its inside diameter Db and 2.8 mm or less, preferably 2.2–2.8 mm, in its thickness Dt.

The method for determining the optimum values of the diameter Db and thickness Dt of the cylinder 11 is as follows.

A magnetron of 900 W preferably has a design value of about 35 mm in its inside diameter Db. The inside diameter Db of the cylinder 11 should be increased in proportion to the power of a magnetron. Accordingly, a magnetron having a power of 1.7 kW or more is designed to be about 40–43 mm in the inside diameter Db of the cylinder 11.

For reference, thermal stress designates a force that is exerted on a unit area of a structure by means of thermal energy. The unit of the thermal stress is $N/m^2$.

The thermal safety coefficient R of a structure is a relative value that defines thermal stress, which is exerted on the structure, in connection with yield stress that is an inherent property of the material of the structure.

That is, the thermal safety coefficient can be defined as follows:

$$R = (\text{the thermal stress of a structure/the yield stress of the material of the structure}) - 1$$

where the yield stress of the material of the structure is the value of the stress at a point at which the material of the structure transits from an elastic area in which the material can be restored to its original shape, to a plastic area in which the material cannot be restored to its original shape while the material is elongated and contracted.

As a result, the smaller the thermal safety coefficient is, the greater the thermal safety of the structure is. Here, since the material of the cylinder 11 of the anode is oxygen-free copper (OFHC) and the material of the straps 13 is stainless steel 304 (STS 304), the maximum thermal stress occurs in the straps 13. Therefore, in calculating the maximum thermal safety coefficient R, a value of $2.4115 \times 10^8$ $N/m^2$, which is the yield stress of STS 304 that is the material of the straps 13, is used as the yield stress of the material.

There are enumerated in Table 1, maximum thermal stresses and thermal safety coefficients that are measured while the inside diameter Db of the cylinder 11 is maintained at 41 mm and the thickness Dt of the cylinder 11 is varied. In a case where the inside diameter Db of the cylinder 11 is 40 or 43 mm, similar test results are obtained.

TABLE 1

| Thickness of the cylinder (mm) | Maximum thermal stress ($N/m^2$) | Thermal safety coefficient (R) |
|---|---|---|
| 2.2 | $12.25 \times 10^8$ | 4.08 |
| 2.5 | $12.49 \times 10^8$ | 4.18 |
| 2.8 | $12.71 \times 10^8$ | 4.27 |
| 3.0 | $13.09 \times 10^8$ | 4.43 |
| 3.8 | $13.82 \times 10^8$ | 4.73 |

In the above Table, it can be understood that since the thermal stress of the structure becomes greater than the yield stress of the material of the structure as the thermal safety coefficient becomes greater, the danger of damage or deformation of the construction becomes greater. Accordingly, when the magnetron has a cylinder of an inside diameter Db of 40–43 mm, the thickness Dt of a cylinder 11 is preferably designed to be 2.8 mm or less, thereby improving the thermal safety of the structure.

On the other hand, when the thickness Dt of a cylinder 11 is designed to be 2.2 mm or less, the thermal safety of the structure is improved due to the reduction of thermal stress, but the maximum temperature in the anode is increased and the change of frequency is increased during a manufacturing process. Hence, this is not desirable.

The portions where maximum temperatures occur are the inner ends of the vanes 12 with which the electrons continuously collide. There are enumerated in Table 2, maximum temperatures that are measured on the inner ends of the vanes 12 while the inside diameter Db of the cylinder 11 is maintained at 41 mm and the thickness Dt of the cylinder 11 is varied.

TABLE 2

| Thickness of a cylinder (mm) | Maximum temperature (° C.) |
|---|---|
| 2.2 | 780 |
| 2.1 | 800 |
| 2.0 | 818 |

In the magnetron, the cylinder 11 and each vane 12, and each vane 12 and each strap 13 are respectively welded together through a brazing process using brazing filler metal comprising silver and copper. Since the brazing filler metal is melted at about 800–900° C. and fixes parts, the welded portions are melted and the welded portions are separated when the maximum interior temperature of the anode becomes greater than 800° C. Accordingly, the thickness Db of the cylinder 11 preferably is 2.2 mm or more at which the maximum interior temperature of the anode becomes equal to or less than 800° C.

In the meantime, in fabricating the magnetron, it is necessary to forcibly fit cooling fins around the cylinder 11. At this time, a large amount of force is exerted on the cylinder 11, so that various defects, such as the deterioration of resonant frequency, may occur. Accordingly, the cylinder 11 should have a certain mechanical strength.

The resonant frequencies of original design and the resonant frequencies after the fitting of the cooling fins with regard to the thickness Dt of the cylinder 11 while the inside diameter Db of the cylinder 11 is maintained at 41 mm are shown in Table 3.

TABLE 3

| Thickness of a cylinder (mm) | Resonant frequency of original design (MHz) | Resonant frequency after the insertion of cooling fins (MHz) | Difference (MHz) |
|---|---|---|---|
| 2.2 | 2455 | 2464 | 9 |
| 2.1 | 2455 | 2466 | 11 |
| 2.0 | 2455 | 2469 | 14 |

After the insertion of the cooling fins, the changed resonant frequency is adjusted to the resonant frequency of original design. In this case, since a resonator is excessively loaded and the frequency is adjusted in an unstable state when the difference is 10 MHz or more, the thickness Db of the cylinder is preferably designed to be 2.2 mm.

As a result, in a case where a magnetron is provided with the cylinder of its anode having an inside diameter Db of 40–43 mm, its thermal stress can be reduced and appropriate mechanical strength can be obtained when the thickness Dt is designed to be 2.2–2.8 mm.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A magnetron, including:

an anode, said anode having a cylinder positioned around a cathode, a plurality of vanes radially fixed to an inner wall of the cylinder, and straps mounted through the vanes;

wherein an inside diameter of the cylinder is 40–43 mm and a thickness of the cylinder is 2.8 mm or less.

2. The magnetron according to claim 1, wherein said thickness of the cylinder is 2.2–2.8 mm.

* * * * *